US005859578A

United States Patent [19]

Arnold

[11] Patent Number: 5,859,578

[45] Date of Patent: Jan. 12, 1999

[54] CURRENT LIMITING SHUNT FOR CURRENT LIMITING CIRCUIT BREAKERS

[75] Inventor: David Arnold, Chester, Conn.

[73] Assignee: General Electric Company, New York, N.Y.

[21] Appl. No.: 811,341

[22] Filed: Mar. 4, 1997

[51] Int. Cl.[6] ..... H01H 9/30

[52] U.S. Cl. ..... 337/110; 337/3; 337/15; 361/103

[58] Field of Search ..... 337/3, 15, 83, 337/110, 125, 333, 379, 380, 383, 384, 388; 361/103, 105

[56] References Cited

U.S. PATENT DOCUMENTS

| | | | |
|---|---|---|---|
| 3,046,371 | 7/1962 | Jencks | 200/88 |
| 3,548,358 | 12/1970 | Klein | 337/83 |
| 4,513,268 | 4/1985 | Seymour et al. | 335/35 |
| 4,573,259 | 3/1986 | Seymour et al. | 29/602 R |
| 4,749,829 | 6/1988 | Ikeda et al. | 200/144 |
| 4,970,481 | 11/1990 | Arnold et al. | 335/6 |
| 5,530,613 | 6/1996 | Bauer et al. | 361/58 |
| 5,667,711 | 9/1997 | Mody et al. | 219/505 |

OTHER PUBLICATIONS

D. Arnold, et al., Circuit Breaker Current Limiting Arc Runner, Filed: 10 Feb. 1987, Docket No. 41PR–7400.

*Primary Examiner*—Leo P. Picard
*Assistant Examiner*—Jayprakash N. Gandhi
*Attorney, Agent, or Firm*—Richard A. Menelly; Carl B. Horton

[57] ABSTRACT

A compact current limiting circuit breaker is equipped with a current limiting shunt for effective over-current circuit interruption. The circuit breaker trip unit responds to long time, short time and instantaneous over-current conditions by opening a set of contacts to isolate the protected circuit. Upon contact separation an arc is drawn, with the endpoints of the arc being initially rooted on the pair of open contacts. Further opening of the contacts commutates the arc into the current limiting shunt to redirect the current away from the trip unit and suppress the arcing current until the circuit breaker contacts are sufficiently open to isolate the protected circuit.

12 Claims, 3 Drawing Sheets

CURRENT LIMITING SHUNT FOR CURRENT LIMITING CIRCUIT BREAKERS

BACKGROUND OF THE INVENTION

Compact electric circuit breakers utilizing movable contact arms operated by an operating mechanism in an insulated housing are employed in a variety of residential, commercial and industrial applications. The over-current sensing trip units for such devices comprise thermal-magnetic trip units typically employed in the high volume, low cost markets. Heating of the thermal element in the thermal-magnetic trip system varies inversely with the square of the current, which results in the use of directly heated bimetals for low ampere rated devices, and indirectly heated bimetals for higher ampere rated circuit breakers. In an indirectly heated bimetal, the current passes through an adjacent heater element which "indirectly" heats the bimetal strip by thermal conduction, convection and radiation. In a directly heated bimetal, $I^2R$ heating occurs by current passage through the bimetal strip. In both trip units, the heat causes the bimetal strip to deflect and operate a trip latch which works in cooperation with the operating mechanism. Under short circuit conditions, abnormally high currents that pass through the directly heated bimetal could possible damage the bimetal.

U.S. Pat. No. 3,046,371 entitled "Circuit Breaker" teaches, inter alia, the use of a bimetal shunt that incorporates shunting contacts that are closed upon actuation of the magnet armature. Closing of the shunt contacts produces an alternate current path that is parallel to and bypasses the bimetal, thereby protecting the bimetal from short circuit currents.

U.S. Pat. No. 3,548,358 entitled "Electric Circuit Breaker with Bimetallic Strip Protective Means" provides additional means to break contact welds that occur under intense short circuit conditions and is effective in protecting the bimetal under short circuit conditions. However, in extremely high short circuit conditions, the parallel path configuration of the shunt system still permits excessively high currents to flow through the bimetal.

U.S. Pat. No. 4,749,829 entitled "Circuit Breaker" teaches the use of an in-line current limiting resistor to reduce the level of let-through current experienced by the thermally sensitive trip unit under short circuit conditions. An ohmic resistor is connected in series between the line strap and trip unit, and thermally coupled to the circuit breaker housing. Under short circuit conditions, the additional in-line resistance limits the maximum current that is permitted to pass through the circuit breaker, effectively protecting the bimetal from damage. During quiescent operating conditions, $I^2R$ heat generated by the ohmic resistor is dissipated by thermal conduction through the circuit breaker housing. The current limiting characteristics of the circuit breaker are enhanced as the resistance value of the resistor increases. However, the amount of resistance that can be incorporated within an ohmic resistor is limited by the overall thermal considerations of the circuit breaker.

U.S. Patent Docket No. 41PR-7406 filed on Feb. 10, 1997 entitled "Circuit Breaker Current Limiting Arc Runner" teaches the use of a current limiting arc runner that does not conduct circuit current under quiescent operating conditions, but does conduct arcing current under overcurrent conditions by commutating the arc to an arc rail whereby additional $I^2R$ thermal heating is eliminated. Since the current limiting arc runner is electrically connected in series with the trip unit during short circuit arcing conditions, the bimetal could be subjected to high levels of instantaneous peak currents.

One purpose of the invention is to provide an efficient bimetal shunting system that completely switches the current to an alternate path upon the occurrence of arcing to bypass the thermally sensitive bimetal during a short circuit overcurrent condition. Another purpose of the invention is to incorporate a current limiting element which does not generate additional $I^2R$ heating during quiescent operating conditions. Yet another purpose of the invention is to incorporate a current limiting element which has superior current suppressing characteristics for effective current limitation during extremely high short circuit over-current conditions.

SUMMARY OF THE INVENTION

A compact current limiting circuit breaker employs a current limiting shunt to protect the circuit breaker thermoelectric trip unit during intense overcurrent conditions. The current limiting shunt is in the current path during short circuit conditions and not in the current path during quiescent conditions. An arc runner commutates the arc current to a shunt path during opening of the circuit breaker contacts over to a polymeric current limiting element for rapid suppression of the current during short circuit interruption.

DESCRIPTION OF THE PREFERRED EMBODIMENT

Figure 1:
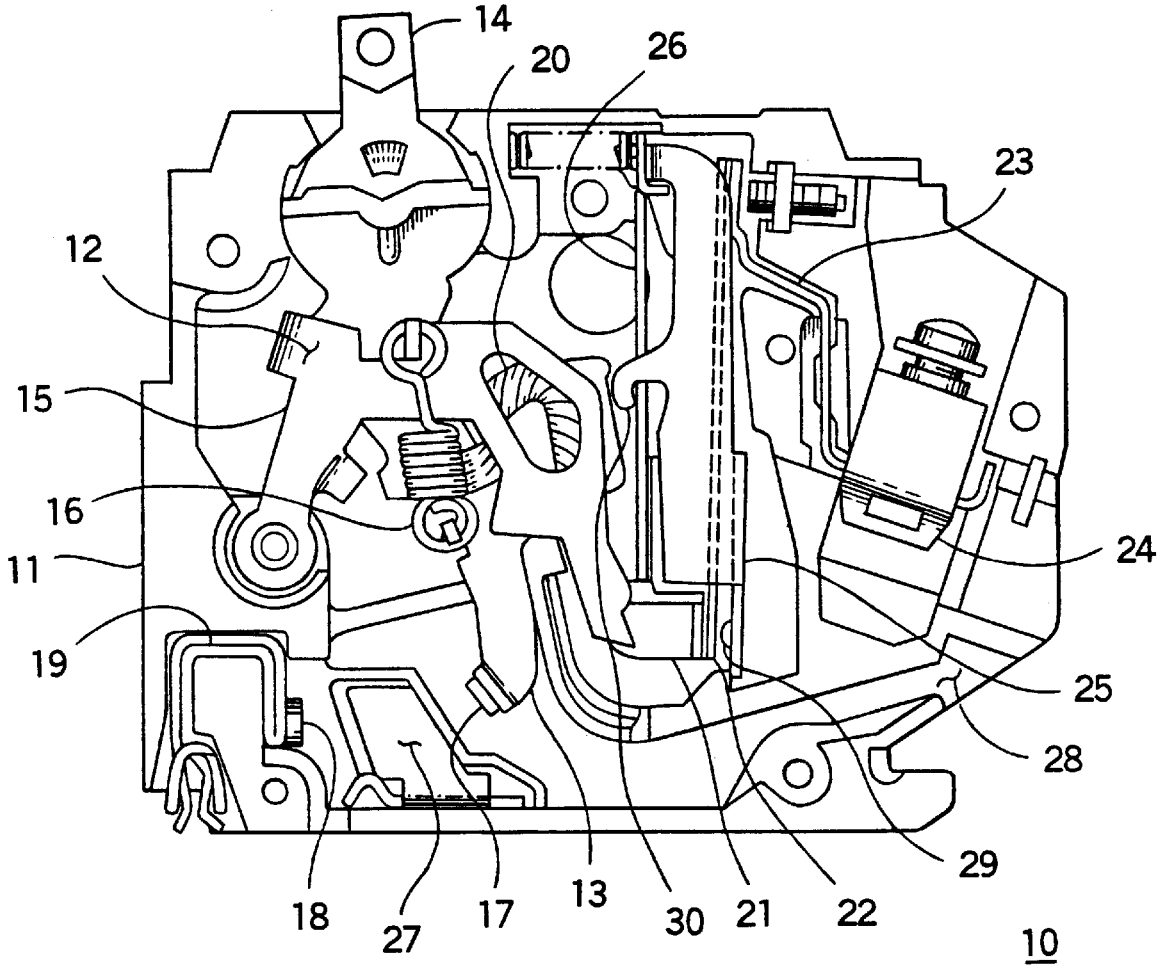
FIG. 1 (PRIOR ART)
FIG. 1 is a side view of a Prior Art molded case circuit breaker with the cover removed to depict the circuit breaker operating components during an "OFF" condition.

FIG. 1 depicts a molded case circuit breaker 10 that operates in accordance with the teachings contained within U.S. Pat. No. 4,513,268 entitled" Automated Q-Line Circuit Breaker and U.S. Pat. No. 4,573,259, entitled "Method of Making an Automated Q-Line Circuit Breaker". A housing 11 contains an operating mechanism 12 that articulates contact arm 13 between an open and closed position for isolation of a protected circuit. Handle 14 cooperates with contact arm 13 by means of a cradle 15 and mechanism spring 16 to effect closure of the protected circuit whereby movable contact 17 abuts stationary contact 18. Line strap 19 contained within the housing 11 provides an electrical connection between the external power source and the circuit breaker internal components. Under quiescent operating conditions, the circuit current passes through the line strap 19, stationary contact 18, movable contact 17, contact arm 13, braid 20, braid terminal 21, bimetal 22, and load strap 23. A load terminal 24 provides means to electrically connect the protected circuit to the circuit breaker. During an electrical overcurrent condition, the current passing through the bimetal 22 generates a magnetic field which is concentrated within magnet 25 and armature 26. Depending on the level of overcurrent, either the bimetal 22 or magnet 25 will effect separation of the circuit breaker contacts as described within the aforementioned U.S. Pat. No. 4,513,268 and 4,573,259. Thermal deflection of the bimetal 22 against projection 29 causes hook 30 to rotate armature 26 and release cradle 15 from a latch surface (not shown) permitting the stored energy in the mechanism spring 16 to actuate the contact arm 13. To ensure proper coordination between the thermal and magnetic trip systems, the current path is arranged within the magnetic circuit of the magnet 25 and armature 26. Opening of the contact arm 13 produces an electrical arc (not shown) that is directed towards the arc chute 27, with eventual extinguishing through exhaust port 28.

Figure 2:
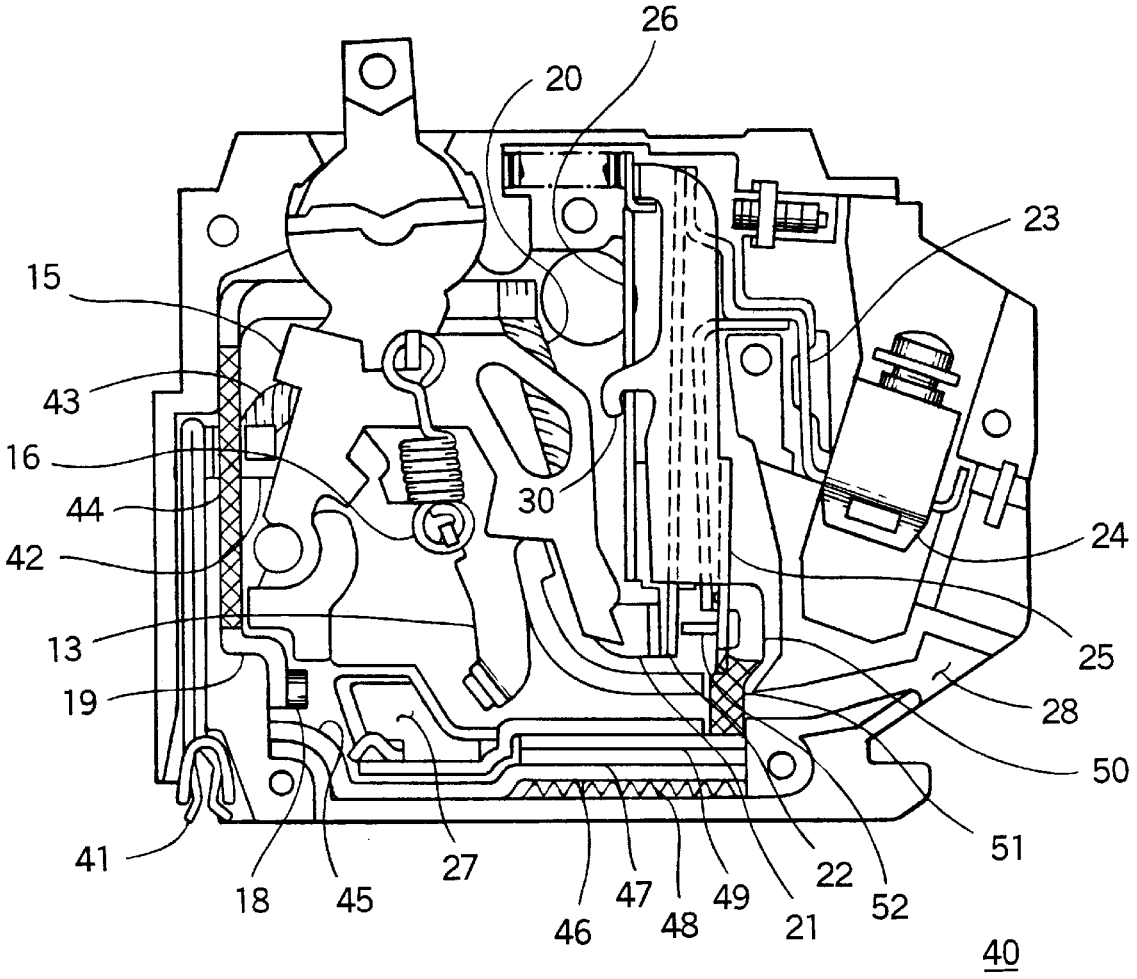
FIG. 2 is a side view of a compact current limiting circuit breaker containing a current limiting shunt in accordance with the invention.
Figure 3:
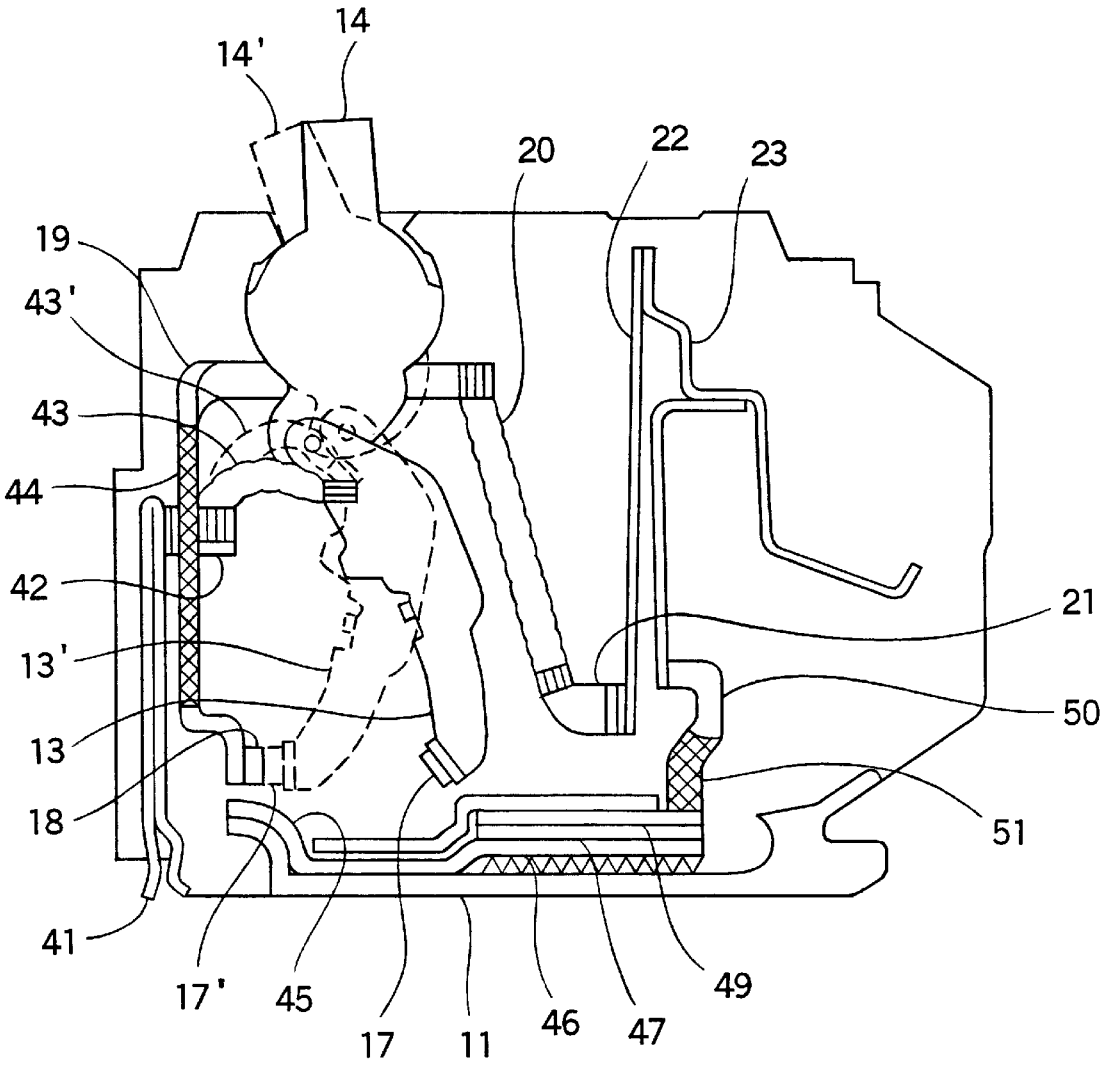
FIG. 3 is a side view with detail removed for clarity of a compact current limiting circuit breaker containing a current limiting shunt in accordance with the invention.

A compact current limiting circuit breaker 40 is shown in FIG. 2, wherein like reference numerals with respect to FIG. 1 designate corresponding parts, and operates in a manner similar to that of the circuit breaker depicted in FIG. 1 except for the inclusion of polymer current limiter as herein described. Line terminal 41 connects to contact arm 13 by means of terminal connector 42 and braid 43. Stationary contact 18 is attached to line strap 19 which is protected by electrical insulation 44 in the vicinity of terminal connector 42. The line strap 19 is electrically connected to the bimetal 22 by means of braid 20 and braid terminal 21. The bimetal 22, contained within the magnetic circuit of the magnet 25 and armature 26, is electrically connected to the load strap 23 and load terminal 24. Under quiescent operating conditions, with the circuit breaker contacts closed such that movable contact 17' abuts stationary contact 18 as shown in phantom in FIG. 3, the load current passes through line terminal 41, terminal connector 42, braid 43', contact arm 13', movable contact 17', stationary contact 18, line strap 19, braid 20, braid terminal 21, bimetal 22, and load strap 23. Opening of the contact arm 13, as depicted in FIGS. 2 and produces an electrical arc that is directed towards the arc chute 27 and driven onto one end of arc runner 45. The other end of arc runner 45 acts as a first electrode 46, which is biased against, thereby forming an interface with, a polymeric conductor 47 by means of spring 48. The opposite surface of polymeric conductor 47 abuts, thereby forming another interface, a second electrode 49 which is attached to an electrode terminal 50 that passes through the magnetic circuit of the magnet 25 and armature 26 and connects with load strap 23. An insulator 51 protects the electrode terminal 50 from exhaust gas deterioration. Circuit interruption is effectuated in the manner described earlier by deflection of the bimetal 22 against post 52 causing hook 30 to rotate armature 26 and release cradle 15 thereby permitting the stored energy in the mechanism spring 16 to actuate the contact arm 13. To ensure thermal and magnetic coordination, the current path in the bimetal 22 or electrode terminal 50 is arranged to pass through the magnet 25 and armature 26. Upon the occurrence of a short circuit condition, magnetic forces exerted on the electric arc commutates the arc onto the arc runner 45 away from the bimetal 22. Under such overcurrent, or abnormal, conditions, the overcurrent passes through line terminal 41, terminal connector 42, braid 43, contact arm 13, movable contact 17, one end of arc runner 45, first electrode 46, first interface 61, polymeric conductor 47, second interface 62, second electrode 49, electrode terminal 50, and load strap 23. The commutated current is rapidly suppressed by the action of the polymer current limiter which operates in a manner described in the aforementioned U.S. application Ser. No. 08/797,152 whereby adiabatic heating at at least one electrode interface of the polymeric conductor, which comprises a polymeric binder with a vaporization temperature at which significant gas evolution occurs below 800° C. and an electrically conductive filler, causes the binder to exceed its vaporization temperature, resulting in at least a partial separation of electrode from polymeric conductor at at least one interface, thereby producing a higher overall device resistance to current flow. Thus, the polymer current limiter limits the flow of current through the short circuited current path without dependence on a polymeric conductor having a positive temperature coefficient of resistance (PTCR). The residual suppressed current is eventually extinguished through exhaust port 28.

I claim:

1. A compact current limiting circuit breaker comprising:

a circuit breaker housing;

a first contact arm having a first contact and a line strap having a second contact arranged within said circuit breaker housing for transfer of current through a protected circuit;

an operating mechanism within said circuit breaker housing arranged for separation of said first and second contacts upon occurrence of an overcurrent condition in said protected circuit;

a trip unit within said circuit breaker housing for articulating said operating mechanism for separation of said first and second contacts to thereby create arc current between said first and second contacts upon occurrence of said overcurrent condition; and a polymer current limiting element having an arc runner arranged proximate said second contact for commutating said arc current into a shunt current path through said current limiting element for rapid suppression of said arc current.

2. The compact current limiting circuit breaker of claim 1 including means for fastening said arc runner to said circuit breaker housing.

3. The compact current limiting circuit breaker claim 1 including a first electrode and a second electrode arranged on opposite sides of said current limiting element.

4. The compact current limiting circuit breaker of claim 1 wherein said current limiting element comprises a polymeric binder with a vaporization temperature at which significant gas evolution occurs below 800° C. and an electrically conductive filler.

5. The compact current limiting circuit breaker of claim 4 further including an interface in series with said polymeric binder and said filler, said interface having a higher resistivity than said polymeric binder and said filler whereby adiabatic resistive heating at said interface causes rapid thermal expansion and vaporization of said polymeric binder causing at least partial separation at said interface.

6. The compact current limiting circuit breaker of claim 5 including means for exerting compressive pressure on said polymeric binder and said filler.

7. The compact current limiting circuit breaker of claim 4 wherein said polymeric binder does not require a PTCR effect.

8. The compact current limiting circuit breaker of claim 3 wherein said arc runner and said first electrode are electrically connected together.

9. The compact current limiting circuit breaker of claim 3 wherein said second electrode is electrically connected to a load strap.

10. The compact current limiting circuit breaker of claim 6 wherein said compressive means comprises a spring.

11. The current limiting are runner of claim 2 where said fastening means comprises an interference fit within said circuit breaker housing.

12. The current limiting device of claim 1 where said shunt current path is electrically in parallel with said trip unit to effectively shunt said current away from said trip unit into said polymer current limiting element.

* * * * *